United States Patent [19]

Fay

[11] Patent Number: 4,736,691

[45] Date of Patent: Apr. 12, 1988

[54] CONTAINER STOPPERING APPARATUS WITH ADJUSTABLE SHELVES

[75] Inventor: John M. Fay, Warminster, Pa.

[73] Assignee: Hull Corporation, Hatboro, Pa.

[21] Appl. No.: 387,260

[22] Filed: Jun. 10, 1982

Related U.S. Application Data

[63] Continuation of Ser. No. 274,076, Jun. 16, 1981.

[51] Int. Cl.[4] ..... B67B 1/04

[52] U.S. Cl. ..... 108/106; 53/264

[58] Field of Search ..... 108/106, 149, 20, 145, 108/148, 96, 107; 53/269; 211/117; 248/249

[56] References Cited

U.S. PATENT DOCUMENTS

| | | | |
|---|---|---|---|
| 1,589,157 | 6/1926 | Hatch, Jr. | 108/106 |
| 2,556,105 | 6/1951 | Rhett | 108/106 |
| 2,915,832 | 12/1959 | Phillips | 108/106 X |
| 2,938,632 | 5/1960 | Mondineo | 108/106 |
| 2,967,625 | 1/1961 | Hoogenstyn | 108/107 X |
| 3,065,860 | 12/1962 | Swanson | 108/106 X |
| 3,104,626 | 9/1963 | Brunette | 108/106 |
| 3,143,980 | 8/1964 | Sperring | 108/149 X |
| 3,537,233 | 11/1970 | Costello et al. | 53/264 |
| 3,709,166 | 1/1973 | Bush | 108/148 X |
| 3,775,942 | 12/1973 | Powell et al. | 53/264 |
| 3,981,250 | 9/1976 | Anthony | 108/106 |
| 4,082,046 | 4/1978 | Baglin | 108/106 |
| 4,295,432 | 10/1981 | Hulke | 108/149 |

*Primary Examiner*—Peter A. Aschenbrenner
*Attorney, Agent, or Firm*—Olson and Olson

[57] ABSTRACT

A housing contains a plurality of vertically spaced shelves movable vertically relative to each other upon activation of a fluid pressure piston-cylinder unit mounted on the housing. Elongated suspension rods depend from the top shelf to support the next two adjacent shelves for relative vertical movement, and each subsequent lower shelf is similarly supported by a shelf above it but separated from it by one intervening shelf. The two top-most shelves also are arranged to be secured together detachably in abutting relationship. The lower end of each suspension rod mounts a rotary disc which supports a pair of upstanding spaced pins arranged in one position of rotary adjustment to abut the underside of a lug extending laterally from the adjacent shelf, and in a second position of rotary adjustment, 90° from the first position, to register with openings in the lug, whereby the associated shelf is lowered from the first position of support a distance substantially equal to the length of the support pins. This support arrangement allows the shelves to be adjusted to four different spacings.

15 Claims, 2 Drawing Sheets

FIG. 1
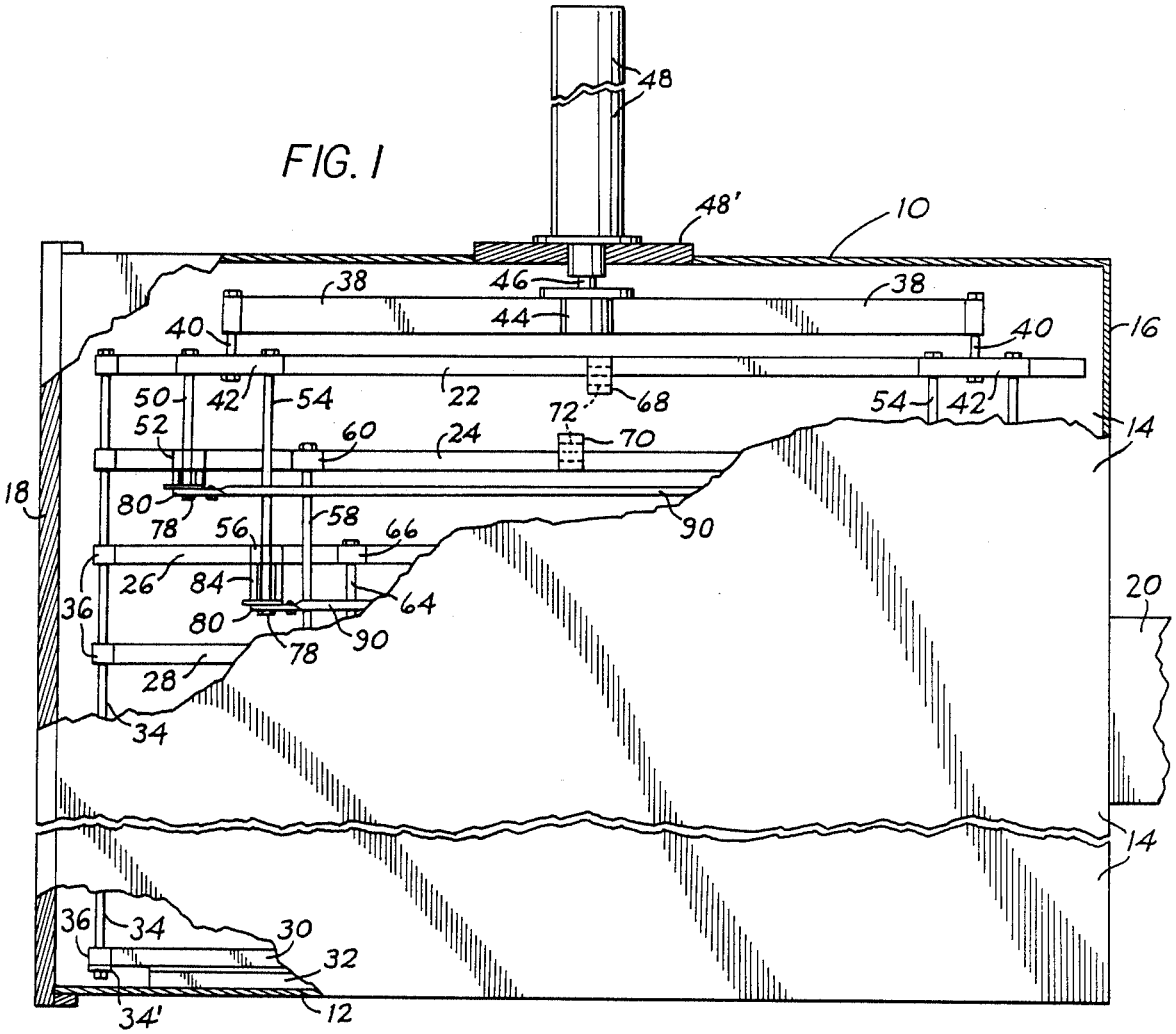
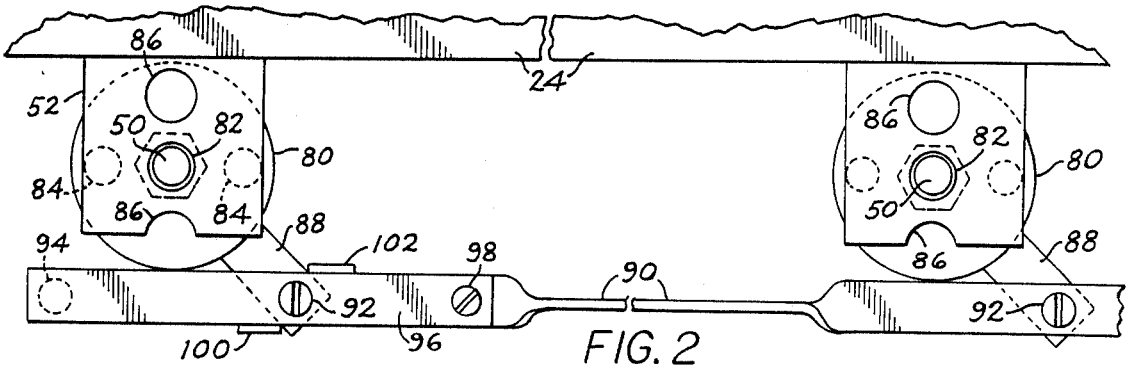
FIG. 2
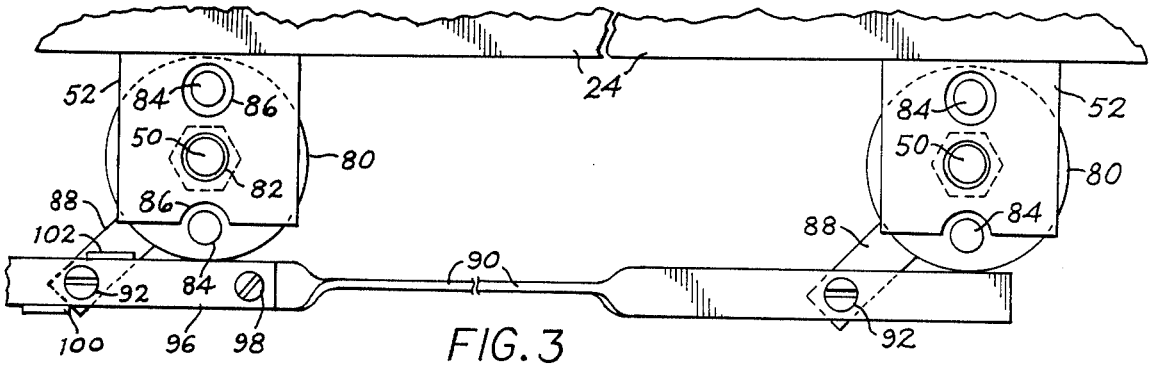
FIG. 3

CONTAINER STOPPERING APPARATUS WITH ADJUSTABLE SHELVES

This application is a continuation of application Ser. No. 274,076, filed June 16, 1981.

BACKGROUND OF THE INVENTION

This invention relates to apparatus for stoppering containers in an evacuated or inert atmosphere, and more particularly to such apparatus which is capable of stoppering containers of different sizes.

This invention is an improvement on an earlier container stoppering apparatus disclosed in U.S. Pat. No. 3,537,233. In one variation of that earlier apparatus, elongated suspension rods are employed to slidably support the second uppermost shelf from the uppermost shelf and each subsequent shelf from a shelf above it but spaced from it by an intervening shelf. The two uppermost shelves also are arranged to be secured detachable in abutting relationship. This support arrangement allows the shelves to be adjusted to two different spacings.

However, there are many instances of use in which it is desirable to provide more than two different spacings in order to accommodate the stoppering of containers of many different sizes. With the earlier apparatus it is necessary to reassemble the shelves with suspension rods of different lengths in order to accommodate other sizes of containers. Such reassembly involves considerable time which is reflected in added costs of labor and production down time.

SUMMARY OF THE INVENTION

In its basic concept, the container stoppering apparatus of this invention utilizes adjustable shelf support means on each of said suspension rod operable in alternate positions of adjustment to support each shelf a different distance from its supporting shelf.

It is by virtue of the foregoing basic concept that the principle objective of this invention is achieved; namely, to overcome the limitations of the earlier container stoppering apparatus.

Another object of this invention is to provide container stoppering apparatus of the class described which allows a plurality of shelves to be adjusted quickly to at least four different spacings.

Still another object of this invention is the provision of apparatus of the class described in which the variability of spacing between adjacent shelves is afforded by a simplified arrangement of pins mounted on suspension rods for rotation relative to perforated lugs on the shelves.

A further object of this invention is the provision of container stoppering apparatus of the class described which is a simplified construction for economical manufacture.

The foregoing and other objects and advantages of this invention will appear from the following detailed description, taken in connection with the accompanying drawings of a preferred embodiment.

BRIEF DESCRIPTION OF THE DRAWINGS

FIG. 1 is a foreshortened side elevation, partly in section, of container stoppering apparatus embodying the features of this invention, the shelves being shown supported in one position of spacing.

FIGS. 2 and 3 are fragmentary, foreshortened plan views of shelf spacing adjusting mechanism, showing the same in shelf-elevating and shelf-lowering positions of adjustment, respectively.

DESCRIPTION OF THE PREFERRED EMBODIMENTS

Figures 4, 5, 6, 7, 8:
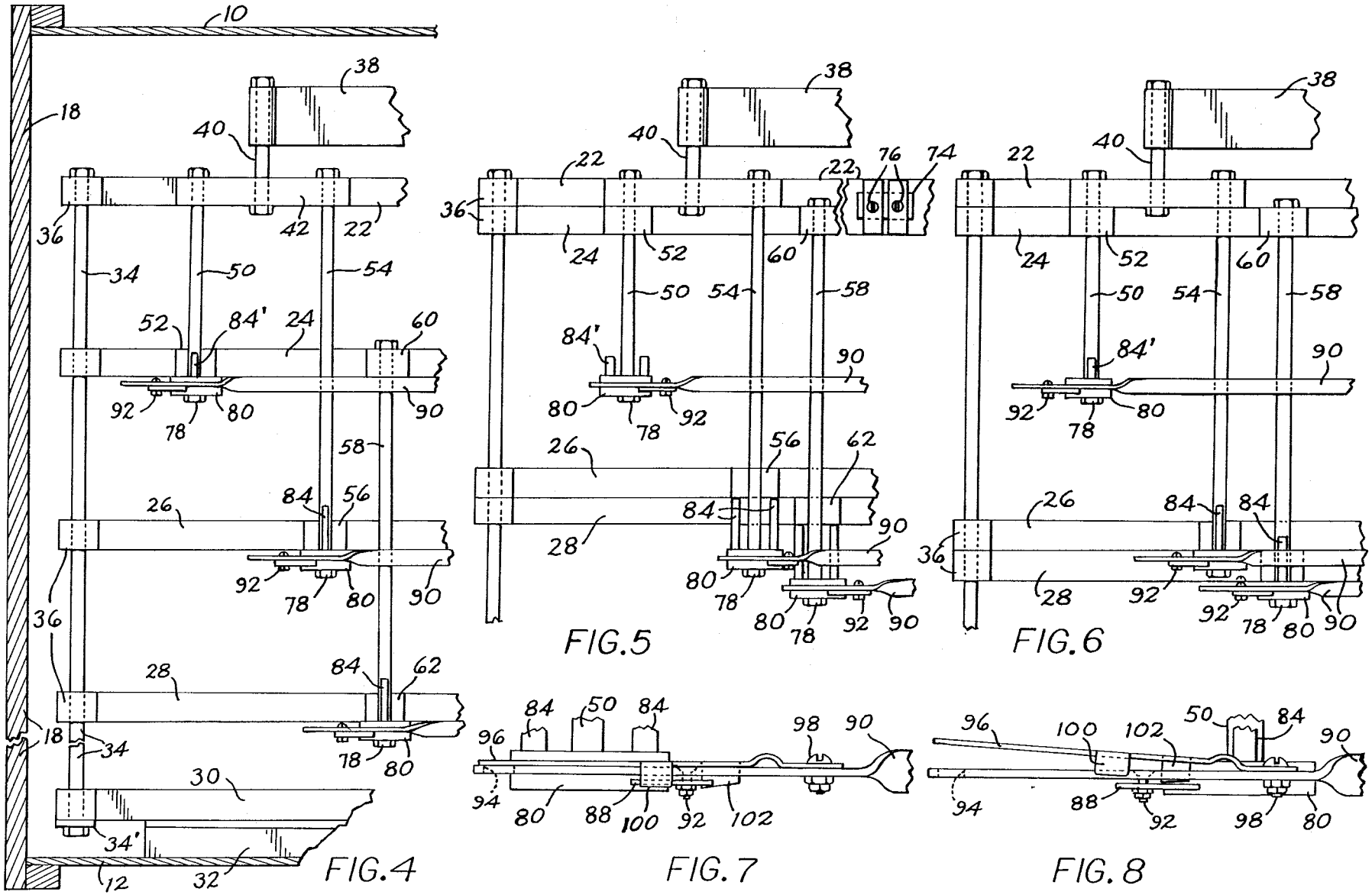
FIG. 4, 5 and 6 are fragmentary, foreshortened views in side elevation, similar to FIG. 1, with the shelves shown to be supported in second, third and fourth positions of spacings.
FIGS. 7 and 8 are fragmentary views in side elevation of shelf locking mechanism in locking and releasing positions of adjustment, respectively.

Referring particularly to FIG. 1 of the drawings, the apparatus illustrated includes a housing having a top wall 10, a bottom wall 12, side walls 14, a rear wall 16 and a front door 18 removably closing the front opening of the housing. The door is secured in closed position by any desirable means, such as peripheral pressure screws as illustrated in the earlier patent previously mentioned. A conduit 20, communicating through the back wall of the housing, may be connected to a vacuum pumping system or a source of inert gas, as desired, for the purpose of providing the interior of the housing with an evacuated or inert atmosphere.

The housing contains within it ia plurality of vertically spaced horizontal shelves. In the foreshortened view of FIG. 1 there is illustrated a top shelf 22, a second lower shelf 24, a third lower shelf 26, fourth lower shelf 28 and the bottommost shelf 30. The bottom shelf is supported from the bottom wall 12 of the housing by a platform formed of a plurality of peripherally arranged load bars 32.

Vertical guide rods 34 extend freely through openings in lugs 36 which are secured to the shelves and extend laterally outward therefrom on the opposite sides of each shelf adjacent the front end thereof. The bottom ends of the guide rods are secured to brackets 34' projecting inward from the side walls 14.

The top shelf 22 of the assembly is supported by a plurality of arms 38 of a support spider, by means of suspension bolts 40 which extends through lugs 42 projecting laterally from the opposite sides of the top shelf adjacent the front and rear ends thereof. The arms 38 radiate from a central hub 44 to which is secured the outer end of a piston rod 46 which projects from the lower end of an hydraulic cylinder 48. The cylinder is supported on the top wall 10 of the housing by the mounting plate 48'.

The shelf 24 next adjacent the top shelf 22 is supported by the latter by means of a plurality of suspension rods 50 which extend freely through openings in the shelf lugs 42 and freely through aligned openings in lugs 52 projecting laterally from the shelf 24.

In similar manner, the third uppermost shelf 26 is supported by the top shelf 22 by suspension rods 54 which extend freely through openings in the lugs 42 and also through aligned openings in lugs 56 which extend laterally from the shelf 26.

The fourth uppermost shelf 28 is supported by the second uppermost shelf 24 by means of suspension rods 58 which extend freely through openings in lugs 60 extending laterally from the shelf 24 and through aligned openings in similar lugs 62 extending laterally from the shelf 28.

A next uppermost shelf [not shown] is supported by the third uppermost shelf 26 by means of suspension rods 64 which extend through aligned openings in lugs 66 projecting laterally from the opposite sides of the third and fifth shelves, as will be understood.

Means is provided for releasably connecting the top and next adjacent shelves together in abutting relationship. As illustrated, a lug 68 extends downward from each lateral side of the top shelf 22, substantially midway between the front and rear ends thereof, and a lug 70 extends upward from each lateral side of the second shelf 24 adjacent the lugs 68. The lugs 68 and 70 are provided with transverse openings 72 which are arranged to align with each other when the shelves are brought into mutual abutment. A connecting pin 74 [FIG. 5] then may be extended through the registering opening 72 and secured against displacement by spring loaded detent pins 76.

The foregoing desribes the structural arrangement of the variation of the earlier apparatus which has been employed heretofore. In that variation, a nut 78 is secured removably to the lower projecting end of each of the suspension rods, for the abuttment by the adjacent lugs which extends laterally from the shelves. As previously mentioned, such an arrangement provides adjustment of the shelves to two different spacings; namely, the uniform spacing between adjacent shelves when two uppermost shelves are not connected together, and the doubled spacing between the second and third, fourth and fifth and similarly subsequent pairs of shelves when the two uppermost shelves are secured together in abutting relationship.

In accordance with this invention, means is provided for accommodating the adjustment of spacing between shelves to at least four different settings. This is achieved in the embodiment illustrated by the provision of a rotatably adjustable support pin assembly for each of the suspension rods.

Thus, each support pin assembly includes a rotary disc 80 provided with a central opening 82 for receiving freely therethrough the lower end of a suspension rod. The disc is supported for rotation on the rod by the bottom removable nut 78.

Each rotary disc 80 mounts a pair of upstanding support pins 84 disposed diametrically opposite each other on opposite sides of the associated suspension rod. The lower lug associated which each suspension rod, for example lug 52 in FIGS. 2 and 3, is provided with a pair of apertures 86 arranged diametrically opposite each other on opposite sides of the suspension rod and spaced apart the same distance as the support pins. Accordingly, in one position of rotation of the rotary disc, shown in FIGS. 3, 4 and 6, th associated pair of support pins registers with the lug apertures 86 and allows the latter to pass through them.

On the other hand, when the rotary disc 80 is rotated 90° to a second position of adjustment, shown in FIGS. 1, 2 and 5, the pair of support pins 84 underlies the associated lug 52 for abutment by the latter. In this position of adjustment the shelf is supported in a position which is elevated above the position shown in FIGS. 3, 4 and 6 by the height of the support pins 84.

Means is provided for rotating the rotary disc and pin assembly between the foregoing two positions of adjustment. In the embodiment illustrated, and best shown in FIGS. 2 and 3, a lever 88 extends radially outward from each rotary disc 80 in a direction to extend laterally outward to the opposite sides of the shelves between the rotary disc 80 and side wall 14 of the housing. The levers which project fromm the rotary discs of each pair on each side of each shelf are connected together to effect simultaneous rotation of the connected bar 90, secured thereto by means of pivot bolts 92. The forward end of each connecting bar, i.e. the end adjacent the front door 18 of the housing, is extended a short distance from the adjacent pivot bolt 92 and is provided with an opening 94 for the reception of a tool by which to manually move the bar and thus rotate the associated pair of rotary discs between the two positions of adjustment of the support pins 84 described hereinbefore.

Means is provided for locking the shelves in the elevated positions of adjustment, supported by the pins 84. This insures against inadvertent rotation of the discs 80 to the position of alignment of the pins 84 with the lug apertures 86 and consquent dropping of the shelf to the lowered position, with possible damage to containers and their contents.

In the embodiment illustrated, and best shown in FIGS. 2, 3, 7 and 8, the inner end of a resilient locking bar 96 is secured to each connecting bar 90, as by bolt 98. The outer end of the locking bar overlies the opening 94. Intermediate the end of the locking bar a pair of longitudinally spaced tabs 100 and 102 extend downward from opposite sides thereof. The tabs are arranged to extend downward along opposite sides of the disc lever 88 (FIGS. 2 and 7) when the disc 80 and pins 84 are in the shelf support position of FIGS. 1, 2, and 5. In this position the tabs prevent rotation of the disc.

When it is desired to rotate the disc 80 to register the pins 84 with the lug apertures (FIG. 3) and lower the shelf to the position of FIG. 4, a tool is inserted upward through opening 94 to bear against the under side of the resilient locking bar 96. Sufficient upward pressure is applied to the tool to move the locking bar upward sufficiently to clear the tabs 100 and 102 from the lever 88 (FIG. 8). The connecting bar 90 then is pulled forward, toward the door 18, by the tool until th disc 80 is rotated to the position of FIG. 3. The tab 102 now rests upon the lever 88 (FIG. 8). Inadvertent rotation of the disc 80 is prevented by engagement of the pins 84 in the lug apertures 86.

When it is desired to return the pins 84 to the shelf support position of FIGS. 1, 2 and 5, the tool is reinserted in opening 94 and the bar 90 is pushed inward, after the shelf has been raised, whereupon the locking bar 96 springs back to the locked position of FIGS. 2 and 7.

To illustrate the operation of the variable shelf spacing mechanism described hereinbefore, let it be assumed for purposes of this description that the spacing between the shelves in FIG. 1 is four inches, that the height of the pairs of support pins 84 which are associated with all of the shelves except the top shelf 22, is two inches and that the height of the pairs of support pins 84' associated with the second shelf 24 is one inch. Accordingly, when the two uppermost shelves 22 and 24 are secured together in abutting relationship, be extending connecting pins 74 through registering openings 72 in the lugs 68 and 70, the arrangement illustrated in FIG. 5 is acheived and the spacing between the second and third, fourth and fifth and subsequent adjacent shelves is eight inches. Of course, the number of openings in which to insert containers to be stoppered is reduced by half.

Referring again to FIG. 1, when the rotary discs 80 are rotated 90° from the illustrated position to the position illustrated in FIG. 3, wherein the pairs of support pins 84 register with the pairs of lug apertures 86, all of the shelves below the top shelf 22 are lowered into abutment with the underlying rotary disc. Thus, the second shelf 24 lowers one inch and all of the underlying shelves except the bottom-most shelf lower two inches. This arrangement is illustrated in FIG. 4, wherein all adjacent shelves are spaced apart five inches.

With the support pins 84 registering with the lug apertures 86 as illustrated in FIG. 4, let it now be assumed that the two uppermost shelves 22 and 24 are secured together in abutting relationship, by means of the connecting pins 74 described hereinbefore. The resulting arrangement is illustrated in FIG. 6, wherein the spacing between the second and third, fourth and fifth, and subsequently adjacent pairs, is ten inches.

From the foregoing description, it will be appreciated that the variable spacing arrangement exemplified provides for the adjustment of the shelves to four different spacings; namely, four, five, eight and ten inches. It will also be understood that additional and different spacings may be provided between certain of the shelves by providing support pins 84 and/or suspension rods of different lengths.

It will be apparent to those skilled in the art that various changes may be made in the size, shape, type number and arrangement of parts described hereinbefore. For example, a single pin 84, or more than the two illustrated, may be used. The rotary disc and pin assembly may be positioned at the upper end of each suspension rod instead of at the bottom, as illustrated, as by providing spring loading between the discs and lugs. The cylinder 48 may be located below the housing for driving connection of its piston rod to the bottom shelf 30, with the top shelf 22 secured to the top wall of the housing. Alternatively, cylinders may be located both top and bottom, as in the earlier patent previously mentioned. These and other changes and modifications may be made without departing from the spirit of this invention and the scope of the appended claims.

Having now described my invention and the manner in which it may be used, I claim:

1. In apparatus having a plurality of vertically spaced apart shelves arranged for movement toward and away from each other, support means interengaging each shelf and a shelf above it for supporting the lower shelf of each interengaged pair by the upper shelf of the pair in said vertically spaced apart relationship, said support means comprising:

(a) a plurality of suspension rods associted with each shelf pair and each extnding from one shelf of the pair freely through an opening in the other shelf of the pair, (b) an adjustment member mounted movably on each suspension rod, and (c) shelf support means on each adjustment member arranged in one position of adjustment adjustment of the adjustment member to engage a confronting surface of the adjacent shelf and in a second position of adjustment to disengage from said surface of the shelf, whereby to change the spacing between the associated interengaged pair of shelves.

2. The apparatus of claim 1 including lock means associated with each adjustment member for preventing movement of the latter from said one position of adjustment to said second position of adjustment.

3.The apparatus of claim 1 including means releasably interconnecting the top two shelves for detachably securing said shelves together in abutting relationship.

4. In apparatus having a plurality of vertically spaced apart shelves arranged for movement toward and away from each other and including laterally projecting lugs having openings arranged to receive suspension rods therethrough, support means interengaging each shelf and a shelf above it for supporting the lower shelf of each interengaged pair by the upper shelf of the pair in said vertically spaced apart relationship, said support means comprisng:

(a) a plurality of suspension rods associated with each shelf pair and each extending from one shelf of the pair freely through the lug openings in the associated shelf pair, (b) an adjustment member mounted movably on each suspension rod, and (c) a pin on each adjustment member arranged in one position of adjustment of the adjustment member to abut the lug associated with the adjustment member and in a second position of adjustment of the adjustment member to be received in an aperture in said lug, whereby to change the spacing between the associated interengaged pair of shelves.

5. The apparatus of claim 4 wherein each adjustment member and pin underlies the associated lug on the lower shelf of each pair of interengaged shelves.

6. In apparatus having a plurality of vertically spaced apart shelves arranged for movement toward and away from each other, support means interengaging each shelf and a shelf above it for supporting the lower shelf of each interengaged pair by the upper shelf of the pair in said vertically spaced apart relationship, said support means comprising:

(a) a plurality of suspension rods associated with each shelf pair and each extending from one shelf of the pair freely through an opening in the other shelf of the pair, there being a pair of suspension rods on each side of each shelf, (b) an adjustment member mounted movably on each suspension rod on each side of each shelf, and connecting bar means interconnecting the adjustment members on each side of each shelf for moving said adjustment members simultaneously, and (c) shelf support means on each adjustment member arranged in one position of adjustment of the adjustment member to engage a confronting surface of the adjacent shelf and in a second position of adjustment to disengage from said surface of the shelf, whereby to change the spacing between the associated interengaged pair of shelves.

7. The apparatus of claim 6 including lock means releasably interengaging each connecting bar and one of the associated adjustment members for preventing movement of the pair of adjustment members from said one position of adjustment to said second position of adjustment.

8. In apparatus having a plurality of vertically spaced apart shelves arranged for movement toward and away each other, support means interengaging each shelf and a shelf above it for supporting the lower shelf of each interengaged pair by the upper shelf of the pair in said vertically spaced apart relationship, said support means comprising:

(a) a plurality of suspension rods associated with each shelf pair and each extending from one shelf of the pair freely through an opening in the other shelf of the pair, (b) a rotary adjustment member mounted on each suspension rod for rotation between first and second positions of adjustment, and (c) shelf support means on each rotary adjustment member arranged in one position of rotary adjustment of the rotary adjustment member to engage a confronting surface of the adjacent shelf and in a second position of rotary adjustment to disengage from said surface of the shelf, whereby to change the spacing between the associated interengaged pair of shelves.

9. The apparatus of claim 8 includiing lock means associated with each rotary member for preventing rotation of the latter from said one position of rotary adjustment to said second position of rotary adjustment.

10. The apparatus of claim 8 wherein the shelves include laterally projecting lugs having openings arranged to receive the suspension rods therethrough, and the support means on each rotary member comprises a pin arranged to abut the lug associated with the rotary member in said one position of rotary adjustment and to be received in an aperture in said lug in said other position of rotary adjustment.

11. The apparatus of claim 10 wherein each rotary member and pin underlies the associated lug on the lower shelf of each pair of interengaged shelves.

12. The apparatus of claim 8 wherein there are a pair of rotary members on each side of each shelf, and connecting bar means interconnects the rotary members of each pair for rotating said rotary members simultaneously.

13. The apparatus of claim 12 including lock means releasably interengaging each connecting bar and one of the associated rotary members for preventing rotation of the pair of rotary members from said one position of rotary adjustment to said second position of rotary adjustment.

14. The apparatus of claim 8 wherein:

(a) the shelves include a pair of laterally projecting lugs on each side of each shelf having openings arranged to receive the suspension rods therethrough, and the support means on each rotary member comprises a pin arranged to abut the lug associated with the rotary member in said one position of rotary adjustment and to be received in an aperture of said lug in said other position of rotary adjustment, (b) connecting bar means interconnect the rotary members of each pair of rotating said rotary members simultaneously, (c) means releasably interconnects the top shelves for detachably securing said shelves together in abutting relationship, and (d) one group of the suspension rods interengage the upper most two shelves and other groups of the suspension rods interengage each of the upper most two shelves with a shelf which is separated therefrom by an intervening shelf, the support pins associated with the suspension rods of said one group being one half the length of the support pins associated with the suspension rods of said other groups.

15. In apparatus having a plurality of vertically spaced apart shelves arranged for movement toward and away from each other, support means interengaging each shelf and a shelf above it for supporting the lower shelf of each interengaged pair by the upper shelf of the pair in said vertically spaced apart relationship, said support means comprising:

(a) a plurality of suspension rods associated with each shelf pair and each extending from one shelf of the pair freely through an opening in the other shelf of the pair, one group of the suspension rods interengaging the uppermost two shelves and other groups of the suspension rods interengaging each of the uppermost two shelves with a shelf which is separated therefrom by an intervening shelf, (b) an adjustment member mounted movably on each suspension rod, and (c) shelf support means on each adjustment member arranged in position of adjustment of the adjustment member to engage a confronting surface of the adjacent shelf and in a second position of adjustment to disengage from said surface of the shelf, whereby to change the spacing between the associated interengaged pair of shelves, the support means associated with the suspension rods of said one group being one half the length of the support means associated with the suspension rods of said other groups.

* * * * *

UNITED STATES PATENT AND TRADEMARK OFFICE

CERTIFICATE OF CORRECTION

PATENT NO. : 4,736,691

DATED : 12 April 1988

INVENTOR(S) : John M. Fay

It is certified that error appears in the above-identified patent and that said Letters Patent are hereby corrected as shown below:

Column 2, line 27, "ia" should read -- a --.

Column 3, line 51, "th" should read -- the --.

Column 5, line 42, after "In" insert -- container stoppering --.
line 47, after "relationship" insert -- while permitting said free movement toward and away from each other --.
line 50, "extnding" should read -- extending --.
line 56, delete "adjustment" (second occurrence).
line 61, after "shelves" insert -- while permitting said free movement of the shelves toward and away from each other --.

Column 8, line 4, "of" (second occurrence) should read -- for --.
line 35, after "in" insert -- one --.

Signed and Sealed this

Eighteenth Day of October, 1988

*Attest:*

*Attesting Officer*

DONALD J. QUIGG

*Commissioner of Patents and Trademarks*